US005582884A

United States Patent [19]

Ball et al.

[11] Patent Number: 5,582,884

[45] Date of Patent: Dec. 10, 1996

[54] PEELABLE LAMINATED STRUCTURES AND PROCESS FOR PRODUCTION THEREOF

[75] Inventors: Melville D. Ball, Kingston, Canada; Laurie A. Coady, Stockholm, Sweden; Werner H. Kuenzi, Hirzel, Switzerland; Robert G. Jones, Kingston, Canada

[73] Assignee: Alcan International Limited, Montreal, Canada

[21] Appl. No.: 168,000

[22] PCT Filed: Sep. 29, 1992

[86] PCT No.: PCT/CA92/00433

§ 371 Date: Feb. 1, 1994

§ 102(e) Date: Feb. 1, 1994

[87] PCT Pub. No.: WO93/06992

PCT Pub. Date: Apr. 15, 1993

[30] Foreign Application Priority Data

Oct. 4, 1991 [CA] Canada ..... 771423

[51] Int. Cl.[6] ..... C25D 11/04; B65D 41/00; B65D 51/00

[52] U.S. Cl. ..... 428/34.1; 205/172; 220/359; 428/35.9; 428/36.5; 428/43; 428/212; 428/304.4; 428/310.5; 428/317.1; 428/343; 428/457; 428/458; 428/460; 428/469; 428/472.2; 428/913

[58] Field of Search ..... 428/43, 34.1, 35.8, 428/36.5, 35.9, 195, 336, 343, 457, 458, 460, 469, 471, 472.2, 913, 304.4, 141, 142, 147, 148, 307.3, 310.5, 212; 383/210, 211; 220/359; 205/170, 171, 172, 83

[56] References Cited

U.S. PATENT DOCUMENTS

| | | | |
|---|---|---|---|
| 2,762,724 | 9/1956 | Brennan | 428/472 |
| 3,927,236 | 12/1975 | Shultz | 428/304 |
| 4,110,147 | 8/1978 | Grunwald et al. | 156/307.5 |
| 4,266,988 | 5/1981 | Krippes | 148/6.21 |
| 4,681,668 | 7/1987 | Davies et al. | 205/139 |
| 4,787,942 | 11/1988 | Wray | 148/6.15 |
| 4,837,061 | 6/1989 | Smits et al. | 428/40 |
| 4,994,314 | 2/1991 | Rosenfeld et al. | 428/36.92 |
| 5,079,089 | 1/1992 | Ito et al. | 428/336 |
| 5,108,812 | 5/1992 | Takahashi et al. | 428/141 |
| 5,112,449 | 5/1992 | Jozefowicz et al. | 205/175 |
| 5,126,210 | 6/1992 | Wieserman et al. | 428/469 |

FOREIGN PATENT DOCUMENTS

| | | |
|---|---|---|
| 178831 | 4/1986 | European Pat. Off. . |
| 181173 | 5/1986 | European Pat. Off. . |
| 381510 | 8/1990 | European Pat. Off. . |
| WO91/04785 | 4/1991 | WIPO . |

OTHER PUBLICATIONS

Yamada et al—"Preparation and Catalytic Properties of Special Alumina Membrane . . . " pp. 175–182, 1988.

*Primary Examiner*—Paul J. Thibodeau
*Assistant Examiner*—Stephen Sand
*Attorney, Agent, or Firm*—Cooper & Dunham LLP

[57] ABSTRACT

The invention provides a peelable laminated structure suitable for use in a peelable seal joining a flexible closure element (23) to a container (20) or in foil/polymer laminates used for packaging and the like. The structure comprises a porous-anodizable metal substrate (11) and a porous anodic film (12) overlying and attached to a surface of the substrate. The porous anodic film (12) has a weakened stratum (19) positioned between an outer film part and an underlying structure including the metal substrate (11). The weakened stratum (19) is strong enough in use of said structure to prevent detachment of the outer film part from the underlying structure, except by deliberate peeling of the flexible closure element (23). The invention also relates to a process for producing the structure and to peelable containers and recyclable laminates incorporating the structure. The structure provides a peeable interface which is not greatly dependent on the characteristics of particular adhesives or bonding techniques used to adhere the metal substrate (11) to the remaining structure, and is thus stable and reliable.

5 Claims, 4 Drawing Sheets

PEELABLE LAMINATED STRUCTURES AND PROCESS FOR PRODUCTION THEREOF

TECHNICAL FIELD

This invention relates to peelable structures which can be used for joining metal layers to layers of other materials in such a way that separation of the layers does not take place during normal handling of the resulting articles, but separation can be brought about by peeling, when desired. The invention also relates to a process for producing such structures and articles containing the structures.

BACKGROUND ART

Peelable laminated structures are used, in particular, in container and packaging technologies.

The use of containers made of metal, metal foil, plastic or glass and provided with peelable closure elements, such as covers, seals, lids or other sealing elements made of metal foil or flexible plastics, is widespread nowadays. For example, containers of this kind are used for packaging human and animal foodstuffs and for protecting articles which have to be kept sanitary or sterile, e.g. medical instruments or equipment, pharmaceutical doses, and the like. The advantage of using containers of this type is that the they are generally inexpensive, can be sealed hermetically and can be opened easily by hand or simple machine.

Sealed containers of this kind may be produced in a variety of types, shapes and sizes. For example, the containers may consist of rigid or semi-rigid shaped hollow bodies having thin flexible metal or plastic lids or may be in the form of flexible metal or plastic pouches having seams which can be peeled apart. The use of metal foils to form part or all of such containers is common because metal foils have good oxygen and moisture barrier properties, good mechanical and thermal properties and can be made to look attractive.

Peelable sealed packages are conventionally made by attaching a closure element to a container by means of an adhesive, a heat sealable lacquer or a heat sealable polymer membrane (usually a polypropylene membrane) having a sufficient adhesive strength to prevent the container from opening prematurely, but nevertheless having a strength low enough to permit the closure element to be peeled away from the container by hand or simple machine when the container is to be opened. Incidentally, to avoid unnecessary repetition, adhesives, lacquers and polymer membranes are referred to collectively throughout the following description and claims merely as "adhesives."

While many peelable adhesives are already known, not all are suitable for use in all cases. For example, the choice of a suitable adhesive is particularly difficult when the container is to be heated prior to being opened, for example if it contains a foodstuff to be served hot or if it contains an item to be pasteurized (heated for a short period at about 80°–85° C.) or sterilized (heated for a longer time usually at a temperature in the range of 120°–130° C.) in heated water or other heating medium. In such circumstances, the adhesive strength is often changed (usually substantially reduced, often by a factor of two or more) during the heating step, leading to a premature failure of the seal or to difficulty when opening the container. To make matters worse, the extent of the change in the adhesive strength is often difficult to predict as it can be very sensitive to variations in adhesive formulations and to variations of time and temperature of the heating process. The presence of moisture or steam can also have a significant effect on the adhesive strength.

Even when the container is not to be subjected to a heating step prior to use, the adhesive still has to be carefully chosen in order to provide a peel strength sufficient to provide an effective and durable seal, while at the same time allowing the container to be opened easily. In the case of products having a long shelf life, the choice of suitable adhesives may be further limited by the need to avoid adhesives which change adhesive properties with age, and in the case of containers intended to hold foodstuffs or other comestibles, the choice is limited to adhesives approved by health care regulations.

In consequence, it will be appreciated that a certain amount of care is required in the choice and application of adhesives for peelable containers, and this often translates into more expensive products or to a limitation of the use of peelable sealed containers for certain items or applications.

It would therefore be advantageous to provide peelable sealed containers incorporating peelable structures having peel characteristics which are less dependent on the choice of the sealing adhesives and which are less sensitive to variations in temperature and processing times.

Furthermore, there is a need for peelable structures of this kind which may be used for applications other than in peelable containers. For example, flexible packaging films often consist of one or more polymer layers laminated to a metal foil so that a desired combination of properties of both materials can be obtained. However, laminated materials of this kind are difficult or expensive to recycle and recyclability is becoming increasingly important both at the factory level (to deal with internally generated scrap, trimmings, etc.) and at the consumer level after sale and use. The difficulty is caused by the bonding together of two different types of materials (metal and plastics) which are recycled by different methods. It would therefore be advantageous to produce laminated films of this kind which could be easily separated into their component materials when desired simply by peeling the materials apart by hand in order to facilitate recycling.

OBJECTS OF THE INVENTION

An object of the invention is therefore to provide a peelable laminated structure suitable for the above-mentioned uses and which overcomes some or all of the above-mentioned drawbacks.

Another object of the invention is to provide such a structure having a peel strength which is affected to a lesser extent by adhesives or other means used to attach the structure to a container, closure element or polymer layer.

Another object of the invention is to provide a peelable structure which shows reduced variation of peel strength upon exposure of the structure to high temperatures, e.g. such as those which are commonly used for preparing foods or sterilizing equipment, or to aging.

Another object of the invention is to provide a process for producing such structures which can be operated economically and with consistent results.

DISCLOSURE OF THE INVENTION

According to one aspect of the present invention there is provided a peelable structure suitable for attaching a metal layer to other layers of a laminated article, the structure comprising a substrate comprising a porous-anodizable metal at its surface, and a porous anodic film overlying and attached to the surface. The porous anodic film is provided with a weakened stratum positioned between an outer film part and an underlying part including the substrate, the weakened stratum being strong enough in use of the structure to prevent detachment of the outer film part from the underlying part, except by deliberate peeling apart of the metal layer and the other layer of the laminated article.

According to another aspect of the invention, there is provided a process for producing a peelable structure suitable for attaching a metal layer to other layers of a laminated article. The process comprises anodizing a surface of a porous anodizable metal in an electrolyte at a voltage which results in the formation of a porous anodic film, continuing the porous anodization while carrying out a voltage reduction procedure in order to introduce a weakened stratum into the anodic film, and allowing the film to stand in said electrolyte or other acidic solution for a period of time to further weaken the film along the stratum; wherein the voltage and the period of time are made such that, under the conditions employed, the weakened stratum is strong enough in use of the structure to prevent detachment of the outer film part from the underlying structure, except by peeling apart of the metal layer and the other layers of the laminated article.

The invention also relates to peelable closed containers, such as rigid or semi-rigid containers or flexible packages or pouches, incorporating the peelable structures of the present invention, and peelable lidding materials, container bodies and packaging films incorporating the peelable structures.

The peelable structures of the present invention not only make the selection of adhesive or lacquer used to form a peelable seal less important, but have peel strengths that are largely unaffected by heat or aging. Moreover, since the structures incorporate porous anodized films, which are ideal for bonding to adhesives or lacquers, the need for pre-treatments of metal foils used for containers to make them more receptive to adhesives has been largely eliminated. Since such pre-treatments often required the use of chromates, which are difficult and expensive to dispose of, this is a considerable advantage. The structures also make it possible to separate foil/polymer laminates when desired, e.g. for recycling.

BEST MODES FOR CARRYING OUT THE INVENTION

In the present invention, use is made of the discovery that it is possible to form an anodic metal oxide film provided with a weakened internal stratum on the surface of an anodizable metal substrate and to use the weakened stratum to enable the anodic film, and any material attached to the film, to be detached from the metal substrate, when desired. In this way, if a material. is attached to the oxide film by means of an adhesive or by direct bonding, the force required for detachment of the material from the metal substrate is not greatly dependent on the adhesive or bonding strength, but rather upon the internal strength of the anodic film at the level of the weakened stratum. Consequently, provided the strength of the adhesive is and remains greater than the strength of the oxide film at the weakened stratum, the peel strength of the laminated structure is not greatly influenced by the way in which the various layers are bonded together. Because the peel strength of the oxide film is substantially unaffected by heat and aging, the resulting laminated structure is more stable over time than many similar structures which depend on peeling of an adhesive layer or the like. Moreover, when an adhesive is employed, less attention has to be paid to the nature of the adhesive and less expensive adhesives can often be used although, of course, adhesives suitable for use with foodstuffs must be selected in those cases where the structure is to be used in containers for foodstuffs, and adhesives capable of withstanding heat must be selected in those cases where the structure is to be used in retortable containers. Despite these considerations, adhesives may be selected from a large group, depending on the application. For example, Morprime 10 B (trade-mark of Morton International), a heat seal lacquer that is commonly used for retortable containers, is suitable in the present invention for many applications.

Having said that the peel strength is not greatly affected by the choice of adhesive, it should be pointed out that the peel strength is not always completely unaffected by the chosen adhesive. This is because the adhesive, or certain components of the adhesive, may penetrate into the pores in the anodic film to the level of the weakened stratum and exert an influence on the peeling operation. Different adhesives moderate the expected peel strength by different amounts and thus the choice of adhesive can be used to "fine tune" the peel strength, if desired.

The process of the present invention begins with the formation of a porous anodic film on a metal substrate and involves the formation of a weakened stratum within the film. The presence of the weakened stratum is necessary because anodic films normally adhere tenaciously to the metal substrates on which they are formed by electrolysis and cannot usually be peeled away from the metal by any means.

Figure 1A:
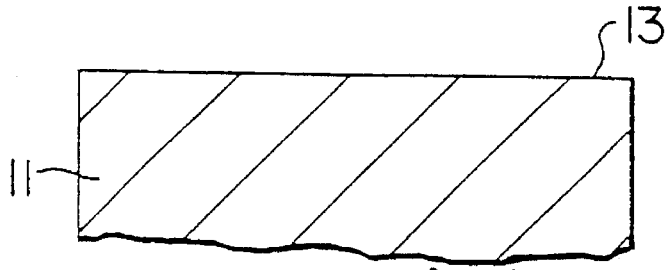
FIGS. 1(A) to 1(D) are schematic cross-sections showing steps in a preferred process according to the present invention.
Figure 1B:
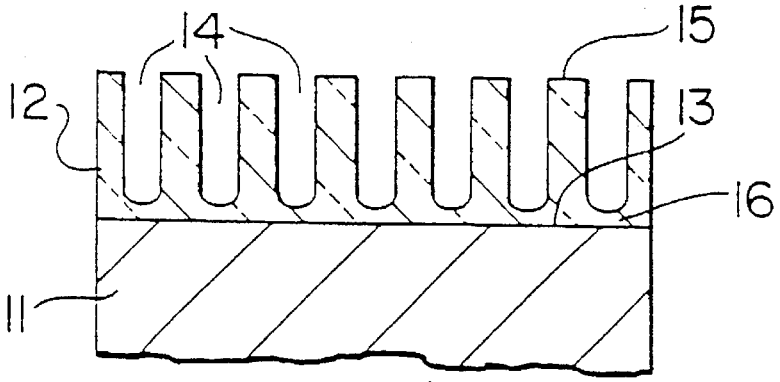

The formation of a weakened stratum in a porous anodic film has been described in our prior European patent publication No. EP 0 178 831 filed in the name of Robin Christopher Furneaux. The various steps in the method, with modifications suitable for the present invention, are shown in simplified form in FIGS. 1(A) to 1(D) of the accompanying drawings. FIG. 1(A) shows a metal substrate 11 made, for example, of aluminum or an anodizable aluminum alloy, on the outer surface 13 of which the weakened anodic film is to be formed. This substrate is subjected to anodization in an electrolyte containing an acid, such as phosphoric acid or sulphuric acid, which results in the formation of a porous anodic film 12 as shown in FIG. 1(B) on the surface 13 of the substrate. The film 12 has numerous pores 14 which are open ended at the outer surface 15 of the film and which extend inwardly towards the metal substrate 11. The pores 14 do not extend completely to the substrate 11 and remain separated from the substrate by a thin, dense non-porous barrier layer 16 of anodic oxide. This barrier layer adheres tenaciously to the metal 11 and prevents easy removal of the film 12 from the substrate.

The pores 14 are formed as a result of a competition between oxide formation resulting from the anodization and oxide dissolution by the acidic electrolyte. The oxide film increases in thickness as the electrolysis proceeds but eventually a maximum thickness is achieved at which overall oxide formation and oxide dissolution are about the same.

Figure 1C:
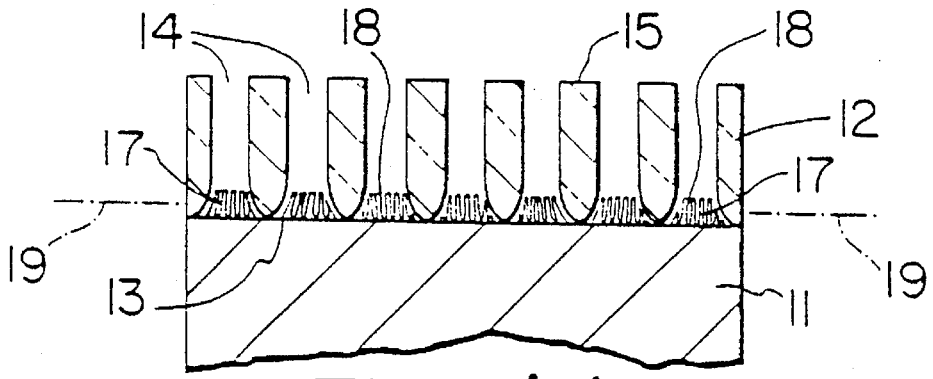

FIG. 1(C) shows the result of a step carried out after the initial anodization resulting in the formation of the porous layer of FIG. 1(B). This additional step involves continued anodization in the same or a similar electrolyte while carrying out a voltage reduction procedure. As the voltage is reduced, the field across the barrier layer 16 is reduced and the current initially stops flowing. With time, the oxide in the pore walls and barrier layer begins to dissolve and the dissolution is fastest in the barrier layer. Eventually, the barrier layer is reduced in thickness to a point where the anodizing current can begin to flow once more at the reduced voltage. A new layer of porous oxide is then formed, but the new growth has a smaller pore size and pore wall thickness than the original film and there is an increase in the number of pores as a result of pore branching. Repeated voltage reduction of this kind, which may be carried out in steps or continuously, results in a progressive refinement of the pores resulting in the formation of branched pore regions 17 at the bottoms 18 of the pores 14 formed in the original film. A final period of soaking of the film in the electrolyte or other solution containing an oxide-etching acid, thins the pore walls further. In the region of the film formed prior to the pore-branching step, this has only a small effect on the pore size and film strength. In the branched pore region 17, however, significant weakening of the film is produced because of the smaller pore wall thickness. As a result, the branched pore regions 17 collectively form a weakened stratum 19 in the film in which the barrier layer is extremely thin or non-existent. This makes it possible to detach the film 12 from the substrate 11 along the weakened stratum.

Figure 1D:
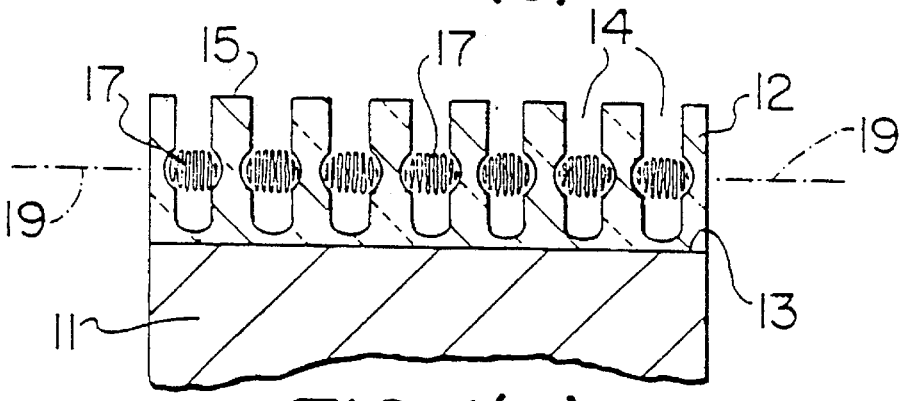

Although the anodization process is normally terminated at the point shown in FIG. 1(C), it is possible to carry out further normal porous anodization after the voltage reduction and soaking steps in order to grow further porous anodic film 12 beneath the weakened stratum 19 as shown in FIG. 1(D). In this way, the weakened stratum 19 can be positioned at virtually any level within the anodic film 12, as desired.

Although this basic procedure is shown in our European patent publication referred to above, the anodization in the prior publication is commenced at a relatively high voltage (typically greater than 100 V) and is continued until a relatively thick (about $50\times10^{-4}$ cm [50 microns]) film is formed. The voltage reduction procedure is carried out over a period of 30 minutes or so until the anodic film completely detaches itself from the underlying metal. In the present invention,it is essential that the anodic film remain attached to the underlying metal. Moreover, the relatively thick anodic films produced according to the prior publication are incompatible with flexible packaging handling machinery. Thus, for example, passing the thick anodized foil over rolls would cause severe crazing and possible spalling of the oxide and this could lead to problems of seal integrity, etc. Moreover, the processing times employed make the processing times employed make the process technology to which the present invention primarily relates, i.e. the container and packaging arts. Accordingly, some modification of the disclosed process is required.

The inventors of the present invention have studied this problem and have identified factors which can affect the peel strength of the resulting film and which can make the process more economical and applicable to thinner, flexible anodic films. In particular, it has now been found that the final peel strength of the anodic film can be controlled by the following factors.

1. Acid Type and Concentration

Since oxide dissolution rates are different for the various commonly used anodizing acids, the oxide films produced by using different acids are different and have different weakening characteristics. For example, phosphoric acid dissolves anodic aluminum oxide faster than sulfuric acid (at equivalent concentrations and temperatures). This means that, using phosphoric acid, the voltage reduction procedure can be carried out relatively quickly, and the final soaking time can be short. With sulfuric acid, the voltage reduction stage takes longer, and a much longer final soak is required.

For many applications, a 1M concentration of phosphoric acid is suitable. For more dilute acid solutions, the processing time is extended and this reduces linespeeds in continuous operations and increases costs. For more concentrated acid solutions, the processing time is reduced, but this can make control of the peel strength more difficult (since very short soak times may need to be accurately controlled). For phosphoric acid, concentrations in the range of 0.1 to 2.0M are usually suitable.

It will therefore be seen that, for rapid continuous processes, phosphoric acid is preferred. It should also be noted that phosphoric acid is more compatible for use with food than some other possible acids (e.g. chromic acid, oxalic acid and sulfuric acid), and thus more desirable when the product is to be used in these applications.

2. Operating Temperature

Since oxide dissolution rates and electrical conductivities are temperature dependent, the oxide film structure and its weakening behaviour can be influenced by the operating temperature. Higher temperatures reduce the time required for the voltage reduction and final soak stages.

In continuous processes, the anodizing current generates some heat and therefore it is advantageous to operate the process at temperatures above ambient (to avoid the need for an auxiliary cooling system). For such a process, temperatures of between about 50° C. and 60° C. are preferred, particularly when using 1M phosphoric acid as the electrolyte.

3. Initial Anodizing Voltage and Voltage Reduction Procedure

Selection of an appropriate initial anodizing voltage is important for two reasons. Firstly, the initial anodizing voltage controls the structure of the exposed surface of the anodic film to which the adhesive must bond. Secondly, this voltage also fixes the starting point for the voltage reduction procedure. It has been found that a preferred range for the starting voltage is between about 5 volts and about 20 volts. Over this range, the surface of the anodic oxide bonds well to heat seal lacquers and other adhesives. By using these relatively low anodizing voltages, the voltage reduction stage is correspondingly short.

The voltage reduction stage involves a stepwise or continuous decrease in the applied voltage. After each voltage reduction step, the anodizing current initially falls, and after a short period (during which the barrier oxide is dissolving)

it begins to recover to a new, slightly lower current. The time between voltage reductions can be adjusted to allow full current recovery. However, surprisingly, it has now been found that it is not necessary to achieve full current recovery at each stage. By choosing voltage reduction steps and times which allow partial current recovery to occur at each stage, only part of the surface area of the sample is undergoing anodization. This gives an additional method for controlling the strength of the weakened stratum. Furthermore, the incomplete current recovery procedure reduces the time required for the voltage reduction stage.

The final voltage (at the end of the voltage reduction sequence) determines the pore structure of the anodic film at the interface. In order to minimise the final soak time, this voltage should be small (e.g. preferably 1 volt or less).

4. Final Soak Time

The final soak stage is designed to partially dissolve the pore walls of the anodic film, so that in regions where the finest pore structure occurs, the strength of the oxide is reduced to a desirable value. For a given film structure, the peel strength of the anodic film is higher for shorter soak times.

For continuous processing, short soak times (preferably a few seconds) are desired. However, when the soak times for a given peel strength are too short, it may be difficult to control the peel strength and may lead to variable properties.

While the focus of the present invention is preferably on the achievement of rapid low cost production processes for commercial reasons, it will be clear that the factors outlined above can be used to achieve a wide range of anodic film structures with a range of peel strengths. Thus peel strengths can be tailored to meet the requirements of particular applications.

As will be apparent from the factors discussed above, a preferred process for producing a structure capable of being peeled manually involves low starting voltages (e.g. 5–15 volts), short anodization periods (e.g. less than one minute and preferably 10–30 seconds), high electrolyte temperatures (e.g. 40°–60° C.) and high acid concentrations (e.g.1M $H_3PO_4$). The voltage reduction procedure preferably employs a stepwise or continuous reduction of voltage of between about 0.2 and 2 volts/second and a final soaking period at a voltage of less than or equal to 1 V for as little as 2 seconds. The short anodization times and low voltages mean that the resulting anodic films are quite thin, i.e. up to about $25\times10^{-4}$ cm [25 microns], but usually less than $1\times10^{-4}$ cm, [1 micron] and optionally less than $0.1\times10^{-4}$ cm [0.1 micron], but they are nevertheless capable of containing the required weakened stratum. In practice, economics and performance constraints govern the oxide thickness. These conditions make the above process commercially attractive and capable of being carried out, if desired, on a continuous basis, but alternative conditions, e.g. higher starting voltages, may be employed, if desired.

The peel strength along the weakened stratum in the structures of the present invention should be such that detachment does not occur accidentally during normal use of the products containing the structures, but such that detachment can be brought about by deliberate peeling. The force required to peel the structure varies from application to application, and depends to some extent on the nature of the product containing the weakened stratum, e.g. the area of attachment of the various layers in the laminate. Relative peel strengths can be compared more accurately by making various samples of the same width and peeling constituent layers of the structures apart from each other at an angle of 180°. Using this comparison, the structures of the present invention can be manufactured in such a way as to produce a wide range of peel strengths, although for the applications mentioned, these would typically fall within the range: 0.3 N/cm to 10 N/cm. For special applications, higher peel strengths can be achieved. As an example, for a peelable foil lidding material used on ALUCON™ 350120F containers, (manufactured by Alcan Deutschland GmbH, Ohle Works), peel strengths, as defined above, are preferably in the range between about 1.5 N/cm to 5 N/cm. In practice, this corresponds to a peel force (at a constant 90° angle of peel) of 8–12 N.

As mentioned briefly earlier, peel strengths may be affected to some extent by the adhesives used to attach the anodic film to an adjacent element such as a peelable lid. It should be kept in mind that the anodic films utilized in the invention are usually very thin, so the weakened stratum is never very far from the outer surface of the film and thus never far from the adhesive layer. Penetration of the adhesive into the weakened stratum is therefore quite possible. Since the position of the weakened stratum within the thickness of the anodic film can itself be controlled by the procedure explained in connection with FIG. 1(D) and since penetration is more likely when the weakened stratum is closer to the surface, penetration by the adhesive can be made more or less likely, as desired, for any particular film thickness. This is a further means of controlling the effect of the adhesive on the peel strength in addition to the choice of adhesive itself.

In general, it has been found that when using a thermoplastic heat-seal lacquer (e.g. Morprime 10 B), a small increase in peel strength is observed after retorting samples for 30 minutes at 130° C. This is attributed to migration of polypropylene from the lacquer into the pores such that the weakened stratum is slightly reinforced. A typical peel force increase produced in this way is from about 10 N to 11 N. This compares favourably with the dramatic change in peel strength observed in some conventional "lacquer controlled" peel systems where peel forces may decrease from more than about 20 N down to about 11 N.

Thus, the weakened stratum in the oxide layer is the main factor controlling peel strength when the heat seal lacquer is of the thermoplastic type. However, the lacquer can make a small contribution to the peel strength under some circumstances (e.g. after elevated temperature/ time treatment).

In those cases where the heat seal lacquer contains certain other components (particularly thermoset components such as epoxy resins), more significant increases in peel strength have been observed after curing. This indicates that the epoxy can flow into the pores and reinforce the weakened stratum.

Consequently, trial and experimentation with various adhesives can produce a range of peelable structures having a spectrum of actual peel strengths making the structures suitable for a variety of end uses.

The peelable structures (metal plus weakened anodic film) produced according to the present invention may be incorporated into sealed containers in order to permit such containers to be opened by peeling, but the way in which the structures are incorporated into the containers can vary from case to case. For example, in the case of a shaped container having a hollow body provided with a flat rim to which a flexible foil lidding material is sealed to close the container, the peelable anodic oxide film may be formed on the lidding material itself (in which case the lidding material forms the peelable structure of the invention), which is then sealed to the rim by a layer of adhesive, or alternatively the peelable anodic oxide film may be formed on the rim of the container body (and/or other parts of the container body, if desired) and then an anodized or unanodized lidding material adhered to the rim via an adhesive layer. The adhesive may be applied first to the container body or alternatively to the lidding material, or it may be introduced as a separate self-supporting sheet or wafer during the sealing process.

If the container is in the form of a pouch, the peelable anodic film may be formed on either one of two sheet-like members adhered together to form the pouch in order to allow the members to be peeled apart when desired.

Figure 2:
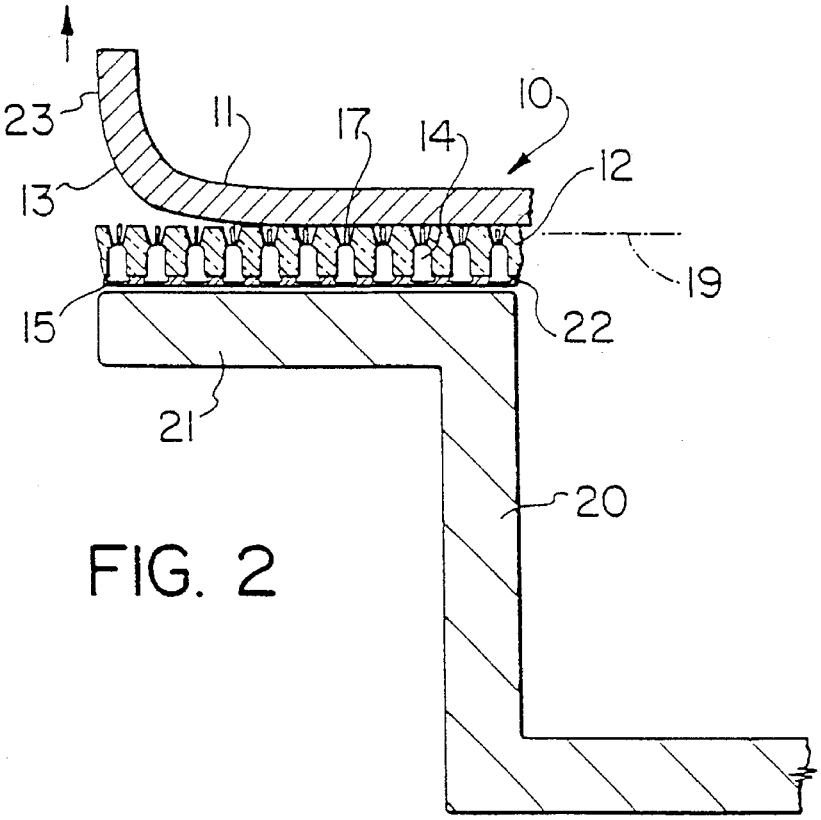
FIG. 2 is an enlarged partial cross-section of a container provided with a lid made of a lidding material according to one embodiment of the invention.
Figure 3:
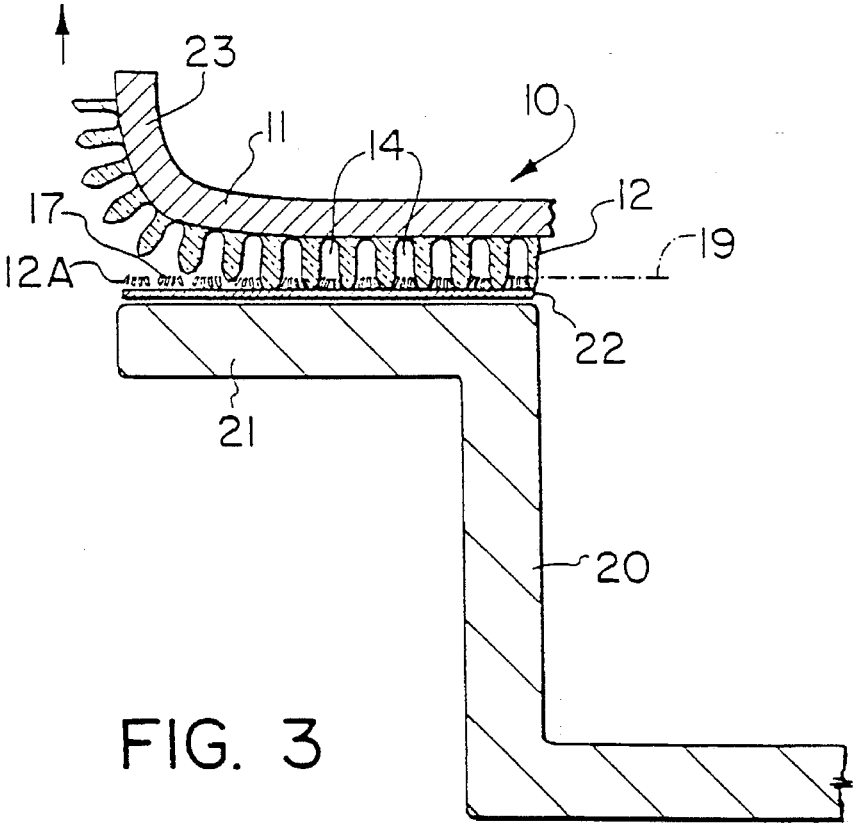
FIG. 3 is a partial cross-section similar to that of FIG. 2 showing a lidding material according to a second embodiment of the invention.

FIGS. 2 and 3 of the accompanying drawings illustrate in more detail the ways in which the peelable structures of the present invention may be incorporated into containers.

FIG. 2 shows a partial cross-section of a container body 20 provided with a lid 10 incorporating a peelable structure according to one form of the present invention attached to a container rim 21. The lid 10 consists of an aluminum foil 11 having an overlying anodic film 12 on its lower side. The film has pores 14 extending from outer surface 15 and the inner end of the pores are provided with branched pore regions 17 forming a weakened stratum 19 adjacent to the underlying surface 13 of the metal. The lid consequently has the structure shown in FIG. 1(C) except that it is inverted.

The outer surface 15 of the anodic film 12 is adhered to the rim 21 of the container 20 by a layer of adhesive 22. The lid 10 extends beyond the rim 21 by a short distance to create a graspable tab 23. As the tab 23 is peeled away from the rim 21 in the direction of the arrow, separation takes place between the foil substrate 11 and the anodic film 12 along the weakened stratum 19. Hence, no separation takes place at or within the adhesive layer 22 and the anodic film 12 (or at least its outer part) remains adhered to the rim 21 of the container after the remainder of the lid has been peeled from the container.

FIG. 3 is a partial cross-sectional view similar to FIG. 2 except that it shows a lid 11 having a structure somewhat similar to that of FIG. 1(D) (except inverted). In this case, the weakened stratum 19 is formed adjacent to the outer surface 15 of the anodic film so that only a very thin outer layer 12*a* of the anodic film remains adhered to the rim of the container after the remainder of the lid material has been peeled away.

The peelable structures illustrated above make it possible to use a variety of adhesives for the adhesive layer 22 used to adhere the lid to the container rim, provided of course that the strength of the adhesive is such that separation takes place along the weakened stratum 19 rather than at or within the adhesive layer 22. Accordingly, specialized peelable adhesive formulations or blends may not have to be employed, and more common and less expensive adhesives may be used instead. Furthermore, since the peel strength of the lidding material is substantially constant, the same lidding material can be used to seal containers of different kinds, sizes, and compositions while still imparting a suitable peel strength.

Although the structures shown in FIGS. 2 and 3 employ a layer 22 of adhesive or lacquer for attachment of the lidding material 10 to the container rim 21, it is also possible to use a layer of heat-sealable material to attach the lid to the container rim. A polyester or other plastic that softens when heated and flows to some extent into the pores 14 and into minute cavities in the rim 21 can be used for this purpose. The heat-sealing material 22 may be applied to the anodic film 12 in advance of the attachment of the lid to the container using standard heat-seal laminating techniques. To seal the resulting lidding material to the container, heat and pressure is required in order to cause the material to flow in the desired manner.

The foil 11 is normally a lidding gauge and grade of aluminum foil. Since the anodizing procedure to impart peelability is required only on one side of the foil, foil which is lacquered or laminated to plastic on the opposite side may be used. Alternatively, the anodization may be carried out in such a way that only one side of the foil material is anodized. However, it is easier on a commercial scale to anodize both surfaces of the foil and to provide the weakened stratum only on one of those surfaces. This makes subsequent printing on the outsides of the lid easier because porous anodized films form good substrates for printing (particularly when the anodization is carried out in phosphoric acid). Usual pretreatments required for printing can thus be avoided. Before anodization is carried out, the foil is usually subjected to the normal degreasing and rinsing procedures.

The anodization and voltage reduction procedures described above are then carried out, normally in such a way that the porous oxide film thickness is quite low (preferably less than about $1\times10^{-4}$ cm [1 micron]).

After the pore reduction process has been completed, a short period of soaking of the foil in the electrolyte will cause some pore wall dissolution. This results in the desired weakening of the metal-oxide interface.

After the period of soaking, and after further normal anodization if this is carried out, the anodized foil is thoroughly rinsed and dried and then the adhesive layer 22 is applied to the outer surface of the anodic film.

Since a thin layer of oxide (12 or 12A) is left on the adhesive 22 after removal of the remainder of the lidding material, a message originally printed on the outer surface of the oxide shows up clearly on the surface of the lid rim once the lid has been removed. This is difficult to do when conventional lidding materials are used because the adhesive layer obscures any message printed on the container rim. Examples of such messages include company slogans and logos, promotional messages, recycling reminders, lottery numbers, etc.

It has been found that the peelable anodic film required in the present invention can be made so thin, while still remaining effective, that the films generate visible colours by optical interference effects. For this to occur, as disclosed for example in our copending European patent application Serial No. 90303069.0 filed Mar. 22, 1990 and published on Sep. 26, 1990 under publication No. EP 0 389 274 A2, it is normally necessary to coat the surface of the anodic film with a discontinuous layer of metal so thin that it is translucent. This can be done, for example, by sputtering. Moreover, the anodic film must be "optically thin", i.e. less than $3\times10^{-4}$ cm [3 microns] and preferably less than $1\times10^{-4}$ cm [1 micron]. Such interference colours may be visible, when the anodic film is used in a structure according to the present invention, if a part of the container or the sealing element are made of transparent material, e.g. transparent plastic or glass. In the region where the container or package seal is formed, the adhesive enters the pores of the anodic film and alters the optical properties compared with the remainder of the film outside the seal area and thus a different colour or appearance is observable. When the sealing element is peeled from the container or package or when the sealing element becomes unattached in part of the seal area, a different visible colour or appearance is produced and this change of colour is irreversible. This means that the generated interference colour can be used to indicate seal integrity or acts as evidence of tampering. Coloured peelable structures produced in this way are particularly useful for containers or packages containing pharmaceuticals and foodstuffs.

Figure 4:
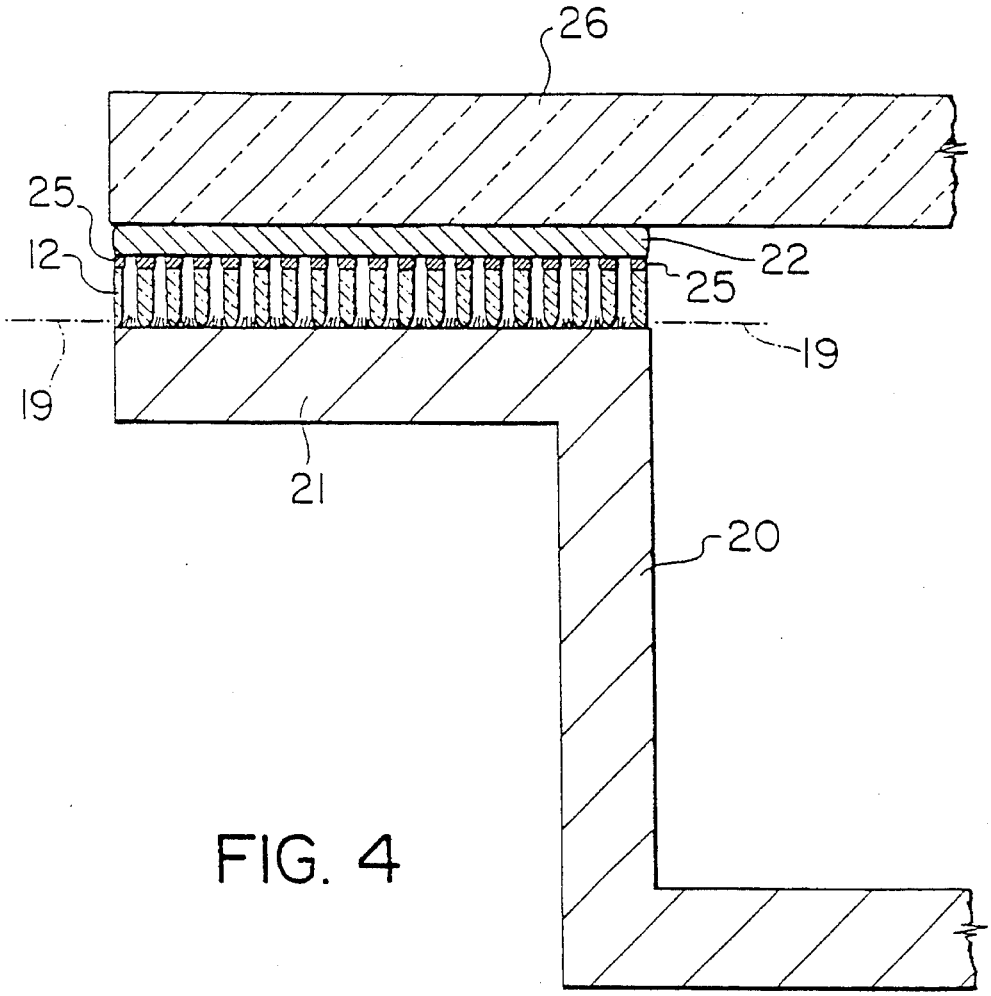
FIG. 4 is a partial cross-section showing a further embodiment of the present invention.

A structure of this type is shown in FIG. 4 of the drawings. In this structure a container body 20 has a rim 21 made of a porous-anodization metal and a weakened anodic film 12 is formed on the rim. The film 12 is optically thin and has a translucent metal layer 25 formed on the outer surface of the film. A layer of adhesive 22 attaches a transparent flexible closure element 26 to the rim. Optical interference effects resulting from light reflected from the surface of translucent metal layer 25 and the underlying rim 21 result in the generation of a visible colour which can be seen through the flexible closure element and the adhesive layer 25. The penetration of some of the adhesive 25 into the pores causes the color to be different in the sealed region than in unsealed regions of the rim or other parts of the container body provided with the coloured structure. Separation along the weakened stratum 19 causes the generated colour to be lost, thus indicating a loss of effective sealing of the container. The colour cannot be regenerated by re-attaching the previously detached anodic film 12 to the rim 21.

Figure 5:
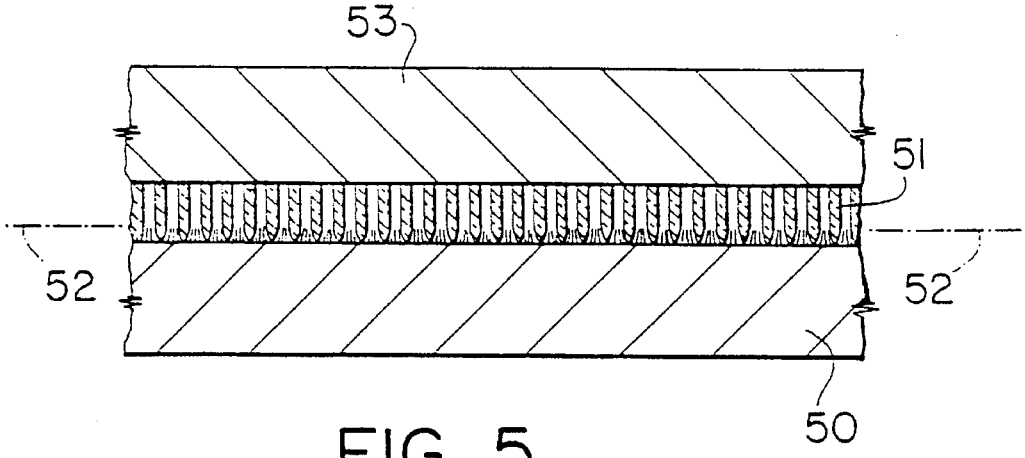
FIG. 5 is a cross-section of a laminated packaging film according to a further embodiment of the present invention.
Figure 6:
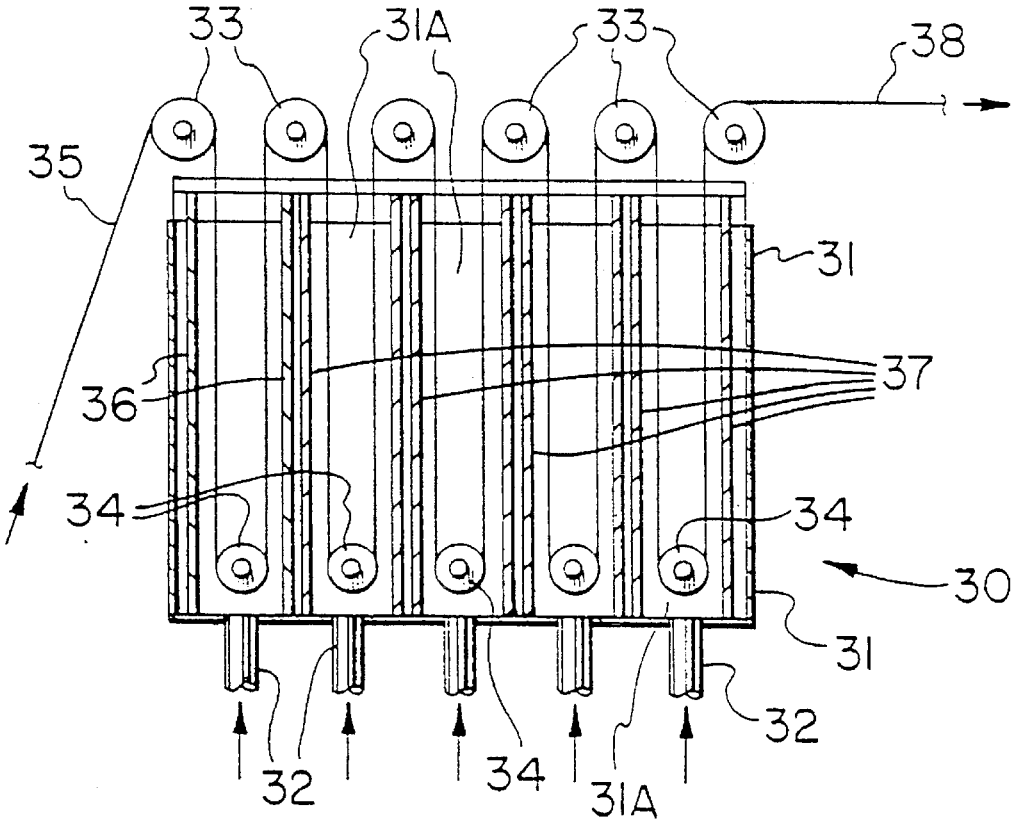
FIG. 6 is a cross-section of an apparatus for operating a process of the invention on a continuous basis.

Although the peelable structures of the present invention have been described above with reference to their use for the formation of peelable sealed containers, the peelable structures of the present invention may also be used in metal foil/polymer laminates of the type commonly used, for example, in the packaging industry. For example, an aluminum foil having an anodic film containing a weakened stratum may be attached by means of an adhesive or by direct heat-sealing to a polymer film made, for example, of polypropylene or other suitable polymer. Other laminating processes, e.g. extrusion coating, may be employed, if desired. A cross-section of a laminated packaging film produced in this way is shown in FIG. 5, in which 50 is a metal foil, 51 is an oxide film having a weakened stratum 52, and 53 is a polymer layer. The polymer layer 53 can be peeled from the metal foil 50 along the weakened stratum 52, when desired.

In these products, the anodic film should be produced in such a way that the peel strength is sufficient to prevent delamination of the structure during normal use, but low enough to permit deliberate delamination during recycling. Normally, the peel strength falls in the range of 0.3 to 10 N/cm and more preferably 1.5 to 5 N/cm (for peeling at a constant 180° angle).

These foil/polymer laminates are recycled in different ways according to the materials employed and the stage of use. For example, when shapes, such as lids etc., are stamped from sheets of the laminates to leave continuous webs of scrap, it is possible to continuously peel apart the polymer layer from the metal foil to give readily recyclable sorted scrap. The foil itself is uncontaminated and the polymer film is left with a very thin (e.g. $0.1\times10^{-4}$ cm [0.1 micron]) layer of porous oxide attached to one surface. With this level of a relatively inert oxide, the polymer film may be reground and recycled into useful products, bearing in mind that, for a $10\times10^{-4}$ cm [10 micron] polymer film, the oxide would represent less than 1% by volume. Inorganic fillers of much higher volume fractions are commonly used in the plastics industry (e.g. talc is a commonly used filler in polypropylene to reduce the cost and give a white coloration).

In the case of laminates which have been used by the consumer, separation of the layers may be carried out either by the consumer or by a commercial recycling facility. In the latter case, it may be possible (e.g. by a cryogenic process) to separate the metal from the polymer more effectively than for normal, adhesively bonded laminates.

In the former case, it is possible to design packages so that the consumer separates the foil from the plastic.

In addition to recycling, there may be other reasons why metal/polymer laminates should be separable. For example, in some packaging applications, a foil layer is provided for its barrier properties but needs to be removed prior to microwave heating. Similarly, there may be applications where it is necessary to remove a foil layer to expose an underlying plastic film which itself has desired functional properties (e.g. a controlled release membrane for an air freshener).

If desired, the process of forming peelable structures according to the present invention may be carried out on a continuous basis in an apparatus of the type shown in FIG. 5. The equipment 30 consists of a tank 31 separated into individual compartments 31A into which an electrolyte may be fed via inlet tubes 32. A first series of rollers 33 is positioned above the tank 31 and a second series of rollers 34 is positioned within the tank 31 near the bottom of each compartment 31A. The rollers are so positioned with respect to each other that a flexible aluminum foil web 35 may be carried over one of the upper rollers 33, moved downwardly through the first compartment of tank 31, carried over one of the lower rollers 34 and moved upwardly through the compartment. This is repeated until the initial section of foil web 35 has completed several (in this case 10) vertical passes through each compartment of the tank, whereupon the web exits the tank. Two anodes 36 in the first tank compartment and two cathodes 37 in each of the subsequent tank compartments are positioned vertically, adjacent to the vertical runs of the web. The anodes and cathodes are connected to a power supply in such a way that the voltage between the cathodes and the foil (anode) can be varied in each tank, or as required to effect the voltage reduction procedure necessary to produce pore weakening, as previously described. The movement of the foil through the tank is controlled at such a speed that a suitable length of time is spent by the foil in each of the tanks and a final soaking period takes place in the final runs of the web under very low (typically 1 V or less) voltage. After emerging from the tank, the foil web 38 is rinsed to remove traces of the acid electrolyte and is then dried. An adhesive layer or heat-sealed polymer film may be applied to the side of the foil having the anodic film provided with the weakened stratum, if desired.

The invention is illustrated in more detail in the Examples provided below. These Examples are provided for the purpose of illustration of the invention rather than limitation of the scope of protection.

EXAMPLE 1

A sample of annealed bright aluminum foil ($70\times10^{-4}$ cm [70 microns]) was anodized in 1M $H_3PO_4$ at 30° C. and 15 V for 3 minutes. The voltage was then stepwise reduced (0.5 V every 6 seconds) to 0 V, and held there for 55 seconds. After rinsing and drying,the foil was coated with a thin layer of Morprime$^R$10 B adhesive (polypropylene dispersion in an organic solvent), cured at 200° C., and heat sealed to an aluminum/polypropylene container filled with water. A second sample, also anodized at 15 V for 3 minutes without the voltage ramp-down and soak at 0 V, was similarly coated and heat sealed to a container. Neither sample leaked after heat sealing. However, the second sample was extremely difficult to peel and ended up tearing in a region removed from the seal, while the first sample with the voltage ramp-down peeled very well, transferring the weakened oxide from the foil lid to the container rim.

EXAMPLE 2

Thinner films (5 V/2 min, 1M $H_3PO_4$ at 30° C. with a soak time of 40 seconds where used and 10 V/30 sec, 1M $H_3PO_4$ at 30° C. with a soak time of 30 seconds where used) were also prepared with and without weakened oxides and sealed to water-filled containers. Small holes were cut in the lids and the samples were than placed in an autoclave for thirty minutes at 121° C. and 15 psi to simulate retorting. No leaking was observed from any of the seals of the containers after this treatment. Again, the samples with the weakened oxide film exhibited the best peeling behaviour.

EXAMPLE 3

A sample was prepared having a weakened zone at the top of the oxide film rather than at the metal/oxide interface. Here, anodizing was done in 1M $H_3PO_4$ at 30° C. by ramping the voltage up to 10 V and immediately bringing it down step-wise to 0 V. After a brief soak (10 seconds) in the electrolyte at 0 V, the voltage was once again ramped up to 10 V for 120 seconds to re-anodize below the branched pores. After applying adhesive and curing it, the foil was heat-sealed to a polypropylene/aluminum container and peeled. The lid appeared to release at this oxide/oxide interface, transferring the branched pores and adhesive to the container rim and leaving the major pores behind on the lid stock.

EXAMPLE 4

Samples were prepared by anodizing $70\times10^{-4}$ cm [70 microns] aluminum foil in 1M phosphoric acid at 15 V and 30° C. for 3 minutes to form a thin porous oxide film approximately 2000 Angstrom thick. The oxide film/metal adhesion was weakened by reducing the voltage in steps to 0 V and allowing sufficient time for the current to recover after each voltage reduction. A final soak was carried out for 55 seconds. A layer of aluminum (250 Angstroms thick) was then deposited on top of the porous oxide by magnetron sputtering, resulting in a thin film interference colour. Following sputtering, the surface of the foil was coated with Norland optical grade adhesive, and a transparent polymer film or thermoformed shape was bonded to the foil on curing of the adhesive in a UV oven. When the polymer component was peeled from the aluminum foil, the colour was lost in the sealed regions.

EXAMPLE 5

A variety of oxide films were formed on aluminum foil at various voltages and the films were allowed to soak in the electrolyte at zero volts for various periods of time. All of the anodization procedures were carried out at 30° C in 1M $H_3PO_4$, using a 60 second soak time at peak voltage. The anodized foils were coated with Morprime 10 $B^R$ adhesive and heat-sealed to ALUCON$^R$250120F containers. The peel strengths of the resulting structures were measured at a constant 90° angle and the results (an average of the results from two samples prepared under each set of conditions) are summarized in the Table below:

TABLE

PEEL STRENGTH VERSUS SOAK TIME/ ANODIZING VOLTAGE

| PEAK VOLTAGE (V) | SOAK TIME AT 0 V (S) | PEEL FORCE (N) |
|---|---|---|
| 5 | 55 | 11.1 |
| 5 | 60 | 10.2 |
| 5 | 65 | 10.2 |
| 10 | 35 | 12.9 |
| 10 | 45 | 8.0 |
| 10 | 50 | 8.6 |
| 15 | 35 | 7.4 |
| 15 | 40 | 7.2 |
| 15 | 45 | 6.9 |

These results show that the peel strength is affected by the duration of the soak time at zero volts and by the anodizing voltage. Longer soak times generally result in lower peel strenghts and lower voltages result in higher peel strenghts.

EXAMPLE 6

Samples of $70\times10^{-4}$ cm [70 microns] aluminum foil were anodized at 10 V in 1M $H_3PO_4$ at 60° C. for 2 seconds following which the voltage was reduced in stages to 1 V or less over the course of 12–14 seconds and then the foil was allowed to soak at 1 V or less for 2–6 seconds. In this case, it is not necessary to include an additional soak at zero volts. The carryover electrolyte wets the foil for a short time prior to rinsing, and thereby will provide the final weakening. These conditions of voltage, time, temperature and electrolyte concentration were chosen to best simulate continuous production of lidstock with a peelable oxide layer. The anodized foils were sealed to ALUCON$^R$ 350120F containers as described in previous Examples and it was found that small variations in the early stages of the voltage ramp-down sequence did not have a pronounced effect on peel strength, the peel strength being mainly controlled by the final stages and the soak stage. The average peel strength (measured at a constant 90° angle) of 45 samples was 9.01 N, the majority falling within the range defined as peelable for the container and test configuration, i.e.8–12 N. It is to be noted that this Example makes use of the incomplete recovery procedure mentioned above.

INDUSTRIAL APPLICABILITY

The present invention can be used to produce sealable containers and packages of various kinds that can be opened by peeling. peelable laminates for packaging applications can also be formed.

What is claimed is:

1. A sealed container comprising a hollow body for holding an object, an opening in a wall of said body, a rim surrounding said opening and a flexible closure element overlapping and attached to said rim and closing said opening, said rim comprising a layer of a metal selected from the group consisting of aluminum and aluminum alloys that are anodizable to form a porous anodic surface film, at least one other layer selected from the group consisting of a portion of the wall of said hollow body and a portion of the closure element and a bonding structure attaching the metal at least one layer to the other layer, said bonding structure comprising a porous anodic film incorporating an internal stratum that is weakened in comparison to a remainder of the anodic film and that has a peel strength high enough to resist separation of the bonding structure at said weakened stratum except upon deliberate peeling apart of said body and said closure element at said rim, wherein said anodic film incorporating said stratum is a film produced by porous anodization of a surface of said metal layer in an electrolyte and at a voltage which results in the formation of said porous anodic film, continuing said porous anodization while carrying out a voltage reduction procedure in order to introduce a weakened stratum into said anodic film, and allowing said film to stand in said electrolyte or other acidic solution for a period of time to further weaken said film along said stratum; and wherein said at least one other layer is attached to said anodic film of said bonding structure by an adhesive, said adhesive having a peel strength greater than said peel strength of said weakened stratum.

2. A container according to claim 1 wherein said weakened stratum has a peel strength of 0.3 to 10 N/cm.

3. A container according to claim 1, and wherein the thickness of said anodic film permits light to be reflected from said metal layer and said translucent metal layer and thereby generates a visible color by an optical interference effect, and wherein at least one of said flexible closure element and said body at said rim is transparent to permit viewing of said color therethrough.

4. A container comprising a hollow body for holding an object, an opening in a wall of said body, and a rim surrounding said opening suitable for attaching a flexible closure element for closing said opening, said rim incorporating a layer of a metal selected from the group consisting of aluminum and aluminum alloys that are anodizable to form a porous anodic surface film and a bonding structure for attaching the metal layer to said flexible closure element, said bonding structure comprising a porous anodic film and incorporating an internal stratum that is weakened in comparison to a remainder of the anodic film and that has a peel strength high enough, after attachment of said flexible closure element, to resist separation of the bonding structure at said weakened stratum, except upon deliberate peeling apart of said body and said closure element at said rim, wherein said anodic film incorporating said stratum is a film produced by porous anodization of a surface of said metal layer in an electrolyte and at a voltage which results in the formation of said porous anodic film, continuing said porous anodization while carrying out a voltage reduction procedure in order to introduce a weakened stratum into said anodic film, and allowing said film to stand in said electrolyte or other acidic solution for a period of time to further weaken said film along said stratum; and wherein a layer of adhesive overlies and is attached to said porous anodic film of said bonding structure, said adhesive having a peel strength, when attached to said closure element, greater than the peel strength of said weakened stratum.

5. A container according to claim 1, wherein said weakened stratum has a peel strength of 0.3 to 10 N/cm.

* * * * *